US011556070B2

(12) United States Patent
Kawauchi et al.

(10) Patent No.: US 11,556,070 B2
(45) Date of Patent: Jan. 17, 2023

(54) CARRIER CORE MATERIAL AND ELECTROPHOTOGRAPHIC DEVELOPMENT CARRIER USING SAME AND ELECTROPHOTOGRAPHIC DEVELOPER

(71) Applicants: DOWA ELECTRONICS MATERIALS CO., LTD., Tokyo (JP); DOWA IP CREATION CO., LTD., Okayama (JP)

(72) Inventors: Takeshi Kawauchi, Okayama (JP); Yohei Ishikawa, Okayama (JP); Hiroyuki Miyano, Okayama (JP)

(73) Assignees: DOWA ELECTRONICS MATERIALS CO., LTD., Tokyo (JP); DOWA IP CREATION CO., LTD., Okayama (JP)

( * ) Notice: Subject to any disclaimer, the term of this patent is extended or adjusted under 35 U.S.C. 154(b) by 776 days.

(21) Appl. No.: 16/492,488

(22) PCT Filed: Mar. 15, 2018

(86) PCT No.: PCT/JP2018/010214
§ 371 (c)(1),
(2) Date: Sep. 9, 2019

(87) PCT Pub. No.: WO2018/173916
PCT Pub. Date: Sep. 27, 2018

(65) Prior Publication Data

US 2021/0132520 A1 May 6, 2021

(30) Foreign Application Priority Data

Mar. 24, 2017 (JP) ..... JP2017-058847

(51) Int. Cl.
*G03G 9/107* (2006.01)
*G03G 9/113* (2006.01)
*G03G 15/08* (2006.01)

(52) U.S. Cl.
CPC ..... *G03G 9/1085* (2020.08); *G03G 9/1075* (2013.01); *G03G 9/1131* (2013.01); *G03G 9/1132* (2013.01); *G03G 15/0822* (2013.01)

(58) Field of Classification Search
CPC ..... G03G 9/1085
See application file for complete search history.

(56) References Cited

FOREIGN PATENT DOCUMENTS

JP H09-236945 A 9/1997
JP 2013-050733 A 3/2013
(Continued)

*Primary Examiner* — Peter L Vajda
(74) *Attorney, Agent, or Firm* — Oliff PLC

(57) ABSTRACT

According to the present invention, there is provided a carrier core material that is formed of ferrite particles in which 48 to 52 mass % of Fe, 16 to 22 mass % of Mn, 1.0 to 3.5 mass % of Mg and 0.05 to 0.5 mass % of Ca are included, and when an electrical resistance value with an applied voltage of 500 V in an environment (in an L/L environment) in which the temperature is 10° C. and the relative humidity is 35% is $R_L$ (Ω·cm), and an electrical resistance value with an applied voltage of 500 V in an environment (in an H/H environment) in which the temperature is 30° C. and the relative humidity is 70% is $R_H$ (Ω·cm), formula (1) below is satisfied.

$$0.1 \leq (\log R_L - \log R_H) \leq 0.3 \quad (1)$$

3 Claims, 2 Drawing Sheets

(56) References Cited

FOREIGN PATENT DOCUMENTS

| | | | | | |
|---|---|---|---|---|---|
| JP | 2014-164061 | A | | 9/2014 | |
| JP | 2015-227268 | | * | 12/2015 | ..... G03G 9/107 |
| WO | 2011/125647 | A1 | | 10/2011 | |

* cited by examiner

CARRIER CORE MATERIAL AND ELECTROPHOTOGRAPHIC DEVELOPMENT CARRIER USING SAME AND ELECTROPHOTOGRAPHIC DEVELOPER

TECHNICAL FIELD

The present invention relates to a carrier core material and an electrophotographic development carrier using such a carrier core material and an electrophotographic developer.

BACKGROUND ART

In an image forming apparatus using an electrophotographic system, such as a facsimile, a printer or a copying machine, a powder toner is adhered to an electrostatic latent image on a photosensitive member so as to be visualized as a toner image, and the toner image is transferred to a sheet or the like and is thereafter melted and fixed to the sheet or the like by being heated and pressurized. Here, developers are roughly divided into a one-component developer which is formed of only a toner and a two-component developer formed of a toner and a carrier. In recent years, since in the two-component developer, the control of charging of the toner has been more easily performed, high-quality images have been more stably obtained and higher-speed development has been allowed, the two-component developer has been more widely used.

In a development system using a two-component developer, a toner and a carrier are agitated and mixed within a development device, and the toner is charged by friction so as to have a predetermined amount. Then, the developer is supplied to a rotating development sleeve, a magnetic brush is formed on the development sleeve and the toner is electrically moved to a photosensitive member through the magnetic brush so as to visualize an electrostatic latent image on the photosensitive member. The carrier after the movement of the toner is separated from the top of the development sleeve, and is mixed again with the toner within the development device. Hence, as the properties of the carrier, a magnetic property for forming the magnetic brush, a charging property for providing desired charge to the toner and like are required.

For example, patent document 1 proposes a technology in which in a carrier core material formed of Li—Mn ferrite particles, the composition of the core material is optimized so as to control charging and magnetization, in which the thickness of a resin coat is made appropriate so as to control electrical resistance and in which thus high-quality images are stably formed.

However, in the carrier core material of patent document 1, as an image formation speed is increased, the speed of agitation/transportation of a developer within a development device is increased, and thus the magnitude of stress exerted on the developer is increased, with the result that a resin coat layer may be peeled off. When the resin coat layer is peeled from a carrier, and thus the carrier core material is exposed, the electrical resistance is significantly lowered, and thus an image defect (carrier development) may be produced. Since the breakdown voltage of the carrier core material is low, when a high bias voltage is applied, an image defect (carrier development) may be produced.

Hence, for example, patent documents 2 to 4 propose technologies for reducing a decrease in carrier resistance when the resistance of a carrier core material is increased, and thus a resin coat layer is peeled off. Specifically, it is proposed that in a Mn ferrite core material, the amount of oxygen in the core material be excessively increased such that a decease in electrical resistance is reduced.

However, when the resistance of the carrier core material is high, the movement of charge is slowed down, and thus after development, counter charge is prevented from leaking smoothly, with the result that when an image formation speed is high, it is likely that a satisfactory image density is not obtained.

Moreover, although image forming apparatuses such as copying machines are generally installed in offices and the like, various environments of offices are present in countries around the world. For example, there are a high temperature and high humidity environment in which the temperature is 30° C. and the relative humidity is 70% and a low temperature and low humidity environment in which the temperature is 10° C. and the relative humidity is 35%. Developers used in the image forming apparatuses are required such that even in the environments with various temperatures and relative humidity as described above, variations in the properties thereof are low, and that so-called environmental stability is satisfactory. In particular, in recent years, knowledge has been obtained in which the environmental stability of electrical resistance of a carrier is an important factor for determining an image quality.

RELATED ART DOCUMENT

Patent Document

Patent Document 1: Japanese Unexamined Patent Application Publication No. H09-236945

Patent Document 2: Publication No. WO2011/125647

Patent Document 3: Japanese Unexamined Patent Application Publication No. 2013-50733

Patent Document 4: Japanese Unexamined Patent Application Publication No. 2014-164061

DISCLOSURE OF THE INVENTION

Problems to be Solved by the Invention

The present invention is made in view of the conventional problems described above, and an object thereof is to provide a carrier core material which has a desired magnetic property and desired electrical resistance and in which even in various environments, the predetermined electrical resistance can be stably maintained.

Another object of the present invention is to provide an electrophotographic development carrier and an electrophotographic developer which can maintain high-quality images in electrophotographic development for a long period of time.

Means for Solving the Problem

According to the present invention, there is provided a carrier core material that is formed of ferrite particles in which 48 to 52 mass % of Fe, 16 to 22 mass % of Mn, 1.0 to 3.5 mass % of Mg and 0.05 to 0.5 mass % of Ca are included, and when an electrical resistance value with an applied voltage of 500 V in an environment (in an L/L environment) in which a temperature is 10° C. and a relative humidity is 35% is $R_L$ (Ω·cm), and an electrical resistance value with an applied voltage of 500 V in an environment (in an H/H environment) in which a temperature is 30° C. and a relative humidity is 70% is $R_H$ (Ω·cm), formula (1) below is satisfied.

$$0.1 \leq (\log R_L - \log R_H) \leq 0.3 \quad (1)$$

In the present specification, unless otherwise specified, "to" is used to mean that values mentioned before and after the "to" are included as the lower limit value and the upper limit value.

Moreover, according to the present invention, there is provided an electrophotographic development carrier in which the surface of the carrier core material described above is coated with a resin.

Furthermore, according to the present invention, there is provided an electrophotographic developer which includes: the electrophotographic development carrier described above; and a toner.

Advantages of the Invention

In the carrier core material of the present invention, a desired magnetic property and desired electrical resistance are obtained, and the predetermined electrical resistance is stably maintained even in various environments.

In the electrophotographic development carrier and the electrophotographic developer of the present invention, even when they are used in a high-speed image forming apparatus, it is possible to obtain images of stable and satisfactory image quality for a long period of time.

DESCRIPTION OF EMBODIMENTS

Figure 1:
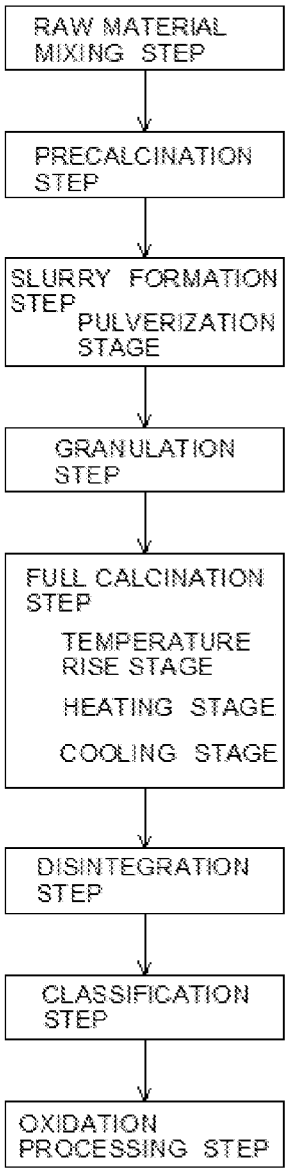
FIG. 1 A flowchart showing an example of the manufacturing process of a carrier core material.

The present inventors et al. have conducted a thorough study for obtaining a desired magnetic property and desired electrical resistance so as to find that when the composition of ferrite particles of a carrier core material is the Mn ferrite disclosed in patent documents 1 to 4, as the electrical resistance is increased, the magnetic property is lowered. Hence, as a result of various studies on the composition of ferrite particles, it is found that a composition which includes Fe, Mn, Mg and Ca is preferable. Specifically, one of the major features of the carrier core material of the present invention is that the composition of ferrite particles of the carrier core material includes 48 to 52 mass % of Fe, 16 to 22 mass % of Mn, 1.0 to 3.5 mass % of Mg and 0.05 to 0.5 mass % of Ca. The composition of the ferrite particles is adjusted in this way, and thus it is possible to obtain the desired magnetic property and the desired electrical resistance.

Then, when the present inventors et al. continue to conduct a further study with the assumption that the ferrite composition described above is used, a problem newly occurs in which Ca may be segregated in the carrier core material such that the composition is displaced, and a problem newly occurs in which when individual component raw materials are mixed into slurry in a manufacturing process, the viscosity of the slurry is increased.

Hence, in order to solve these new problems, a further study is conducted, and consequently, the raw materials are mixed and calcined (precalcined) and are thereafter pulverized into precalcined powder, the precalcined powder is mixed with a medium such as water into slurry and the slurry is granulated and calcined (fully calcined). In this way, the raw materials are uniformly dispersed, and thus Ca is prevented from being segregated in the carrier core material.

It is found that it is important that the particle diameter $D_{90}$ of the precalcined powder when the precalcined powder is formed into the slurry is set equal to or less than 3.5 μm. The particle diameter $D_{90}$ of the precalcined powder in the slurry is set equal to or less than 3.5 μm, and thus the number of coarse particles in the slurry is decreased, and thus in the subsequent calcination step, abnormal crystal growth is prevented from occurring, with the result that the environmental stability of the electrical resistance of the carrier core material is enhanced. The particle diameter $D_{90}$ means the particle diameter at the time of 90% cumulation in a particle diameter cumulative distribution. In order for the particle diameter $D_{90}$ of the precalcined powder in the slurry to be set equal to or less than 3.5 μm, before being put into a dispersion medium such as water, the precalcined powder may be pulverized with a pulverization device or after being put into the dispersion medium, the precalcined powder in the slurry may be wet-pulverized with a wet pulverization device.

Another of the major features of the carrier core material of the present invention is that when an electrical resistance value with an applied voltage of 500 V in an L/L environment is assumed to be $R_L$ (Ω·cm), and an electrical resistance value with an applied voltage of 500 V in an H/H environment is assumed to be $R_H$ (Ω·cm), formula (1) described previously is satisfied. In other words, the environmental stability of the electrical resistance of the carrier core material is enhanced. In order to enhance the environmental stability of the electrical resistance of the carrier core material, it is preferable to adjust an oxygen concentration in a calcined atmosphere in a full calcination step when the carrier core material is manufactured. The details thereof will be described below on the discussion of a method of manufacturing the carrier core material.

(Method of Manufacturing Carrier Core Material)

The method of manufacturing the carrier core material according to the present invention will be described below. FIG. 1 is a flowchart showing a typical process in an example of the method of manufacturing the carrier core material according to the present invention. The example of the method of manufacturing the carrier core material according to the present invention will be described below with reference to FIG. 1.

(Raw Material Mixing Step)

A Fe component raw material of a carrier core material according to an embodiment of the present invention is preferably metal Fe or an oxide thereof. Specifically, $Fe_2O_3$, $Fe_3O_4$, Fe or the like which is stably present at normal temperature and pressure is suitably used. A Mn component raw material is preferably metal Mn or an oxide thereof. Specifically, metal Mn, $MnO_2$, $Mn_2O_3$, $Mn_3O_4$ or $MnCO_3$ which is stably present at normal temperature and pressure is suitably used. As a Mg component raw material, MgO, $Mg(OH)_2$ or $MgCO_3$ can be suitably used. As a Ca component raw material, metal Ca or an oxide thereof is suitably used. Specific examples thereof include $CaCO_3$ which is a carbonate, $Ca(OH)_2$ which is a hydroxide and CaO which is an oxide. The component raw materials (the Fe component raw material, the Mn component raw material, the Mg component raw material and the Ca component raw material and the like) described above are mixed so as to form an intended composition.

(Precalcination Step)

The obtained mixture is heated in a heating furnace in the atmosphere and is held for a predetermined time so as to be precalcined. In this way, the raw materials which are mixed in the forms of a carbonate, a hydroxide and the like are formed into lumps that are substantially in the form of an oxide, and volatile components, nonmetallic inclusions and the like are decomposed and evaporated so as to be removed. Then, the obtained lumps are cooled and are then pulverized with a pulverizer such as a dry ball mill, and thus the particle diameter $D_{90}$ of the precalcined powder is set equal to or less than 3.5 μm. The precalcination temperature preferably falls within a range of 600 to 1000° C., and more preferably falls within a range of 700 to 900° C. Preferably, when the precalcination temperature is equal to or more than 600° C., a reaction proceeds such that part is formed into a Mg ferrite, and thus the viscosity increase problem when the raw materials are formed into the slurry is prevented from occurring. On the other hand, preferably, when the precalcination temperature is equal to or less than 1000° C., the raw materials are prevented from being excessively sintered. The precalcination time preferably falls within a range of 1 to 5 hours.

(Slurry Formation Step)

The produced precalcined powder is put into the dispersion medium and is mixed so as to produce slurry. The solid content concentration of the slurry preferably falls within a range of 40 to 90 mass %. As the dispersion medium used in the present invention, water is suitable. In addition to the precalcined powder, as necessary, a binder, a dispersion agent, a reducing agent or the like may be mixed with the dispersion medium. As the binder, for example, polyvinyl alcohol can be suitably used. The amount of binder mixed is preferably set such that the concentration of the slurry is about 0.5 to 2 mass %. As the dispersion agent, for example, polycarboxylic acid ammonium and the like can be suitably used. The amount of dispersion agent mixed is preferably set such that the concentration of the slurry is about 0.5 to 2 mass %. As the reducing agent, carbon powder, a polycarboxylic acid organic substance, a polyacrylic acid organic substance, maleic acid, acetic acid, a polyvinyl alcohol (PVA) organic substance and mixtures thereof can be suitably used. In addition, a lubricant, a sintering accelerator and the like may be mixed.

Then, the slurry produced as described above is wet-pulverized. For example, a ball mill or a vibration mill is used to wet-pulverize the slurry for a predetermined time such that the particle diameter $D_{90}$ of the precalcined powder in the slurry is set equal to or less than 3.5 μm. In the vibration mill or the ball mill, a medium having a predetermined particle diameter is preferably included. Examples of the material of the medium include a Fe-based chrome steel and oxide-based zirconia, titania and alumina. The form of the pulverization step may be any one of a continuous type and a batch type. The particle diameter of the pulverized material is adjusted by the pulverization time, a rotation speed, the material and particle diameter of the medium used and the like.

(Granulation Step)

Then, the pulverized slurry is spray-dried so as to be granulated. Specifically, the slurry is introduced into a spray drying machine such as a spray drier and is sprayed into an atmosphere so as to be granulated in a spherical shape. The temperature of the atmosphere at the time of spray drying preferably falls within a range of 100 to 300° C. In this way, it is possible to obtain the granulated powder whose particle diameter is 10 to 200 μm and which is formed in a spherical shape. Preferably, in the obtained granulated powder, coarse particles and fine powder are removed with a vibrating sieve or the like, and thus a particle size distribution becomes sharp. For example, particles whose particle diameter is equal to or less than 5 μm but equal to or more than 100 μm are sieved so as to be removed.

(Full Calcination Step)

Figure 2:
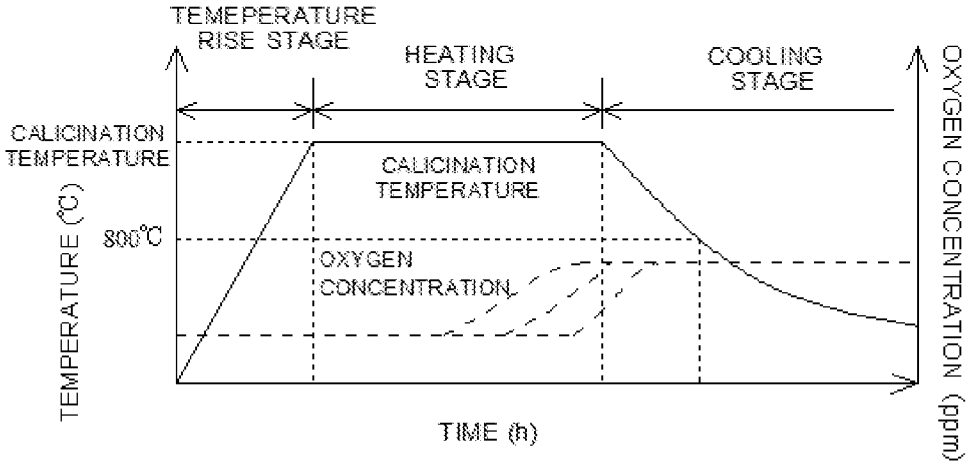
FIG. 2 A diagram showing chronological changes in a temperature and an oxygen concentration in a calcination step.

Then, the granulated powder is calcined. This full calcination step includes: a temperature rise stage in which the temperature of the granulated powder is increased to a calcination temperature (top temperature); a heating stage in which the calcination temperature is held for a predetermined time so as to perform calcination; and a cooling stage in which cooling is performed from the calcination temperature to room temperature. FIG. 2 is a diagram showing chronological changes in the temperature and the oxygen concentration in the full calcination step.

In the heating stage, the calcination temperature is set to about 1000 to 1200° C., and the holding time after the calcination temperature is reached is set to 3 to 24 hours.

Here, in the full calcination step, it is important to switch the oxygen concentration in a calcined atmosphere to a higher concentration in the second half of the heating stage. When the sintering of the ferrite particles (granulated powder) is almost completed, the oxygen concentration is increased, and thus desired oxidation occurs in the ferrite particles, with the result that the electrical resistance is increased and the environmental stability with high electrical resistance is obtained.

The switching of the oxygen concentration in the calcined atmosphere is started at least one hour before the completion of the heating stage. However, as the holding time of the calcination temperature, at least two or more hours are acquired. The switching time of the oxygen concentration is set within a range of 1 to 3 hours, and the switching of the oxygen concentration is completed by the time the calcination temperature becomes less than 800° C. As long as the conditions described above are satisfied, the switching of the oxygen concentration may be completed either in the heating stage or in the cooling stage.

The oxygen concentration in the calcined atmosphere before the switching preferably falls within a range of 2000 to 8000 ppm, and the oxygen concentration in the calcined atmosphere after the switching preferably falls within a range of 4000 to 9000 ppm. A difference in the oxygen concentration before and after the switching preferably falls within a range of 1000 to 4000 ppm.

(Disintegration Step)

The calcined material obtained in this way is disintegrated. Specifically, for example, the calcined material is disintegrated with a hammer mill or the like. The form of the disintegration step may be any one of a continuous type and a batch type.

(Classification Step)

After the disintegration step, as necessary, classification may be performed such that the particle diameters are made to fall within a predetermined range. As a classification method, a conventional known method such as air classification or sieve classification can be used. After primary classification is performed with an air classifier, with a vibration sieve or an ultrasonic sieve, the particle diameters may be made to fall within the predetermined range. Furthermore, after the classification step, nonmagnetic particles may be removed with a magnetic field concentrator. The particle diameter of the ferrite particle preferably falls within a range of 25 to 50 μm.

(Oxidation Processing Step)

Then, the ferrite particles after the classification are heated in an oxidizing atmosphere, and thus an oxide film is formed on the surface of the particles, with the result that the resistance of the ferrite particles may be increased. Specifically, in the electrical resistance value $R_N$ of the ferrite particles, log $R_N$ in an environment (in an N/N environment) in which the temperature is 22° C. and the relative humidity is 50% when a voltage of 500 V is applied preferably falls within a range of 8.1 to 8.8. The electrical resistance value of the ferrite particles is increased, and thus it is possible to reduce the possibility of carrier scattering caused by the leakage of charge. The oxidizing atmosphere may be either the atmosphere or a mixed atmosphere of oxygen and nitrogen. The heating temperature preferably falls within a range of 200 to 800° C., and more preferably falls within a range of 250 to 600° C. The heating time preferably falls within a range of 0.5 to 5 hours. The oxidation processing step as described above is arbitrarily performed as necessary.

(Electrophotographic Development Carrier)

The ferrite particles which are produced as described above are used as the carrier core material of the present invention. Then, in order for desired chargeability and the like to be obtained, the outer circumference of the carrier core material is coated with the resin and is used as an electrophotographic development carrier.

As the resin with which the surface of the carrier core material is coated, a conventional known resin can be used. Examples thereof include polyethylene, polypropylene, polyvinyl chloride, poly-4-methylpentene-1, polyvinylidene chloride, an ABS (acrylonitrile-butadiene-styrene) resin, polystyrene, (meth) acrylic resins, polyvinyl alcohol resins, thermoplastic elastomers such as polyvinyl chloride, polyurethane, polyester, polyamide and polybutadiene thermoplastic elastomers and fluorine silicone resins.

In order to coat the surface of the carrier core material with the resin, a solution of the resin or a dispersion liquid is preferably applied to the carrier core material. As the solvent for the coating solution, one or two or more types of aromatic hydrocarbon solvents such as toluene and xylene; ketone solvents such as acetone, methyl ethyl ketone, methyl isobutyl ketone and cyclohexanone; cyclic ether solvents such as tetrahydrofuran and dioxane; alcohol solvents such as ethanol, propanol and butanol; cellosolve solvents such as ethyl cellosolve and butyl cellosolve; ester solvents such as ethyl acetate and butyl acetate; amide solvents such as dimethylformamide and dimethylacetamide; and the like can be used. The concentration of resin components in the coating solution generally falls within a range of 0.001 to 30 mass %, and particularly preferably falls within a range of 0.001 to 2 mass %.

As a method of coating the carrier core material with the resin, for example, a spray dry method, a fluidized bed method, a spray dry method using a fluidized bed and a dipping method can be used. Among them, since it is possible to efficiently perform coating with a small amount of resin, the fluidized bed method is particularly preferable. For example, in the case of the fluidized bed method, the amount of resin coated can be adjusted by the amount of resin solution sprayed and the spraying time.

With respect to the particle diameter of the carrier, in general, its volume average particle diameter preferably falls within a range of 25 to 50 μm, and particularly preferably falls within a range of 30 to 40 μm.

(Electrophotographic Developer)

The electrophotographic developer according to the present invention is formed by mixing the carrier produced as described above and the toner. The mixing ratio between the carrier and the toner is not particularly limited, and is preferably determined, as necessary, from development conditions of a development device used or the like. In general, the concentration of the toner in the developer preferably falls within a range of 1 to 15 mass %. This is because when the concentration of the toner is less than 1 mass %, an image density is excessively lowered whereas when the concentration of the toner exceeds 15 mass %, the toner is scattered within the development device, and thus a stain within an apparatus may be produced or a failure may occur in which the toner is adhered to a background part of transfer paper or the like. The concentration of the toner more preferably falls within a range of 3 to 10 mass %.

As the toner, a toner can be used which is manufactured by a conventional known method such as a polymerization method, a milling/classification method, a melting granulation method or a spray granulation method. Specifically, a toner can be suitably used in which a coloring agent, a mold release agent, a charge control agent and the like are contained in a binder resin whose main component is a thermoplastic resin.

With respect to the particle diameter of the toner, in general, its volume average particle diameter by a coulter counter preferably falls within a range of 5 to 15 μm, and more preferably falls within a range of 7 to 12 μm.

A modifier may be added to the surface of the toner as necessary. Examples of the modifier include silica, alumina, zinc oxide, titanium oxide, magnesium oxide and polymethyl methacrylate. One or two or more types thereof can be combined and used.

The mixing of the carrier and the toner can be performed with a conventional known mixing device. For example, a Henschel mixer, a V-type mixer, a tumbler mixer and a hybridizer can be used.

EXAMPLES

Example 1

68.0 kg of $Fe_2O_3$ (average particle diameter: 0.6 μm), 29.3 kg of $Mn_3O_4$ (average particle diameter: 2 μm), 2.20 kg of MgO and 0.5 kg of $CaCO_3$ were mixed. The mixture was heated at 800° C. for 2 hours, and thus precalcined powder was obtained. The obtained precalcined powder was pulverized, 25 kg of the precalcined powder after being pulverized was dispersed in 8.7 kg of water, as a dispersant, 150 g of an ammonium polycarboxylate dispersant and as a reducing agent, 100 g of carbon black was added, the mixture was subjected to pulverization processing with a wet ball mill (medium diameter of 2 mm) and thus the mixed slurry was obtained. The particle diameter $D_{90}$ of the precalcined powder in the slurry was 2.4 μm.

The slurry was sprayed with a spray drier into hot air of about 130° C., and thus dried granulated powder was obtained. Here, the granulated powder which had a particle size distribution other than an intended particle size distribution was removed with a sieve.

The granulated powder was put into an electric calcination furnace, and was held at a temperature of 1100° C. for 5 hours so as to be fully calcined. In the full calcination step, control was performed such that an oxygen concentration in a calcined atmosphere was 5000 ppm until 4 hours after the temperature rise stage and the calcination temperature were reached, and the oxygen concentration in the calcined atmosphere was switched from 5000 ppm to 6500 ppm over 1 hour after 1 hour before the completion of a calcination stage. Thereafter, while the oxygen concentration described above was being maintained, cooling was performed. The obtained calcined material was disintegrated and was thereafter classified with a sieve, and thus a carrier core material having an average particle diameter of 32 μm was obtained. Furthermore, the obtained carrier core material was held at a temperature of 400° C. for 1 hour in the atmosphere so as to be subjected to oxidation processing, and thus a carrier core material according to example 1 was obtained. The composition, the magnetic property and the electrical property of the obtained carrier core material are shown in table 1.

Example 2

A carrier core material according to example 2 was obtained in the same method as in example 1 except that the oxygen concentration in the calcination step was switched over 3 hours after 3 hours before the completion of the calcination stage. The composition, the magnetic property and the electrical property of the obtained carrier core material are shown in table 1.

Example 3

A carrier core material according to example 3 was obtained in the same method as in example 1 except that the oxygen concentration after the switching in the calcination step was 9000 ppm. The composition, the magnetic property and the electrical property of the obtained carrier core material are shown in table 1.

Example 4

A carrier core material according to example 4 was obtained in the same method as in example 1 except that the oxygen concentration before the switching in the calcination step was 2000 ppm and that the oxygen concentration after the switching was 4000 ppm. The composition, the magnetic property and the electrical property of the obtained carrier core material are shown in table 1.

Example 5

A carrier core material according to example 5 was obtained in the same method as in example 1 except that the oxygen concentration before the switching in the calcination step was 8000 ppm and that the oxygen concentration after the switching was 9000 ppm. The composition, the magnetic property and the electrical property of the obtained carrier core material are shown in table 1.

Example 6

A carrier core material according to example 6 was obtained in the same method as in example 1 except that the particle diameter $D_{90}$ of the precalcined powder in the slurry was 1.5 μm. The composition, the magnetic property and the electrical property of the obtained carrier core material are shown in table 1.

Example 7

A carrier core material according to example 7 was obtained in the same method as in example 1 except that the particle diameter $D_{90}$ of the precalcined powder in the slurry was 3.5 μm. The composition, the magnetic property and the electrical property of the obtained carrier core material are shown in table 1.

Example 8

A carrier core material according to example 8 was obtained in the same method as in example 1 except that the composition of Ca was 0.05 mass %. The composition, the magnetic property and the electrical property of the obtained carrier core material are shown in table 1.

Example 9

A carrier core material according to example 9 was obtained in the same method as in example 1 except that the composition of Ca was 0.5 mass %. The composition, the magnetic property and the electrical property of the obtained carrier core material are shown in table 1.

Example 10

A carrier core material according to example 10 was obtained in the same method as in example 1 except that Fe was 51 mass %, Mn was 17 mass % and Mg was 3.1 mass %. The composition, the magnetic property and the electrical property of the obtained carrier core material are shown in table 1.

Comparative Example 1

A carrier core material according to comparative example 1 was obtained in the same method as in example 1 except that the oxygen concentration in the full calcination step and the cooling step was so constant as to be 5000 ppm. The composition, the magnetic property and the electrical property of the obtained carrier core material are shown in table 1.

Comparative Example 2

A carrier core material according to comparative example 2 was obtained in the same method as in example 1 except that the oxygen concentration in the calcination step was switched over 5 hours after 3 hours before the completion of the calcination stage. When the switching of the oxygen concentration was completed, the cooling stage was entered from the heating stage, the temperature within the calcination furnace here was less than 800° C. The composition, the magnetic property and the electrical property of the obtained carrier core material are shown in table 1.

COMPARATIVE EXAMPLE 3

A carrier core material according to comparative example 3 was obtained in the same method as in example 1 except that the oxygen concentration before the switching in the calcination step was 5000 ppm and that the oxygen concentration after the switching was/12000 ppm. The composition, the magnetic property and the electrical property of the obtained carrier core material are shown in table 1.

Comparative Example 4

A carrier core material according to comparative example 4 was obtained in the same method as in example 1 except that the oxygen concentration in the calcination step and the cooling step was so constant as to be 1000 ppm. The composition, the magnetic property and the electrical property of the obtained carrier core material are shown in table 1.

Comparative Example 5

A carrier core material according to comparative example 5 was obtained in the same method as in example 1 except that the precalcination was not performed and that the particle diameter $D_{90}$ of the precalcined powder in the slurry was 0.9 μm. The composition, the magnetic property and the electrical property of the obtained carrier core material are shown in table 1.

Comparative Example 6

A carrier core material according to comparative example 6 was obtained in the same method as in example 1 except that the precalcination temperature was 1000° C. and that the particle diameter $D_{90}$ of the precalcined powder in the slurry was 4.0 μm. The composition, the magnetic property and the electrical property of the obtained carrier core material are shown in table 1.

Comparative Example 7

A carrier core material according to comparative example 7 was obtained in the same method as in example 1 except that the component of Ca was 0 mass %. The composition, the magnetic property and the electrical property of the obtained carrier core material are shown in table 1.

Comparative Example 8

A carrier core material according to comparative example 8 was obtained in the same method as in example 1 except that the component of Ca was 0.6 mass %. The composition, the magnetic property and the electrical property of the obtained carrier core material are shown in table 1.

(Analysis of Composition)

(Quantification of Total Amount of Fe)

The carrier core material was weighed and dissolved in mixed acid water of hydrochloric acid and nitric acid. This solution was evaporated to dryness and was thereafter dissolved again by adding sulfuric acid water thereto, and thus excessive hydrochloric acid and nitric acid were volatilized. Solid aluminum was added to this solution, and thus $Fe^{3+}$ ions in the liquid were reduced to $Fe^{2+}$ ions. Then, the amount of $Fe^{2+}$ ions in this solution was subjected to potentiometric titration using a potassium permanganate solution, and thus quantitative analysis was performed, with the result that the titer of total Fe was determined.

(Analysis of Mn)

For the content of Mn in the carrier core material, quantitative analysis was performed according to a ferromanganese analysis method (potentiometric titration method) described in JIS G 1311-1987. The content of Mn in the carrier core material described in the present invention is the amount of Mn which was obtained by performing the quantitative analysis with the ferromanganese analysis method (potentiometric titration method).

(Analysis of Mg and Ca)

The contents of Mg and Ca in the carrier core material were analyzed by the following method. The carrier core material according to the present invention was dissolved in an acid solution, and quantitative analysis was performed with ICP. The contents of Mg and Ca in the carrier core material described in the present invention were the amounts of Mg and Ca which were obtained by the quantitative analysis with ICP.

(Measurement of Electrical Resistance of Carrier Core Material)

The carrier core material was adjusted in humidity for one day and night with a constant temperature and humidity chamber (made by ESPEC CORP., MODEL; PH-1KT) in an environment (in an N/N environment) in which the temperature is 22° C. and the relative humidity is 50%, in an environment (in an L/L environment) in which the temperature is 10° C. and the relative humidity is 35% and in an environment (in an H/H environment) in which the temperature is 30° C. and the relative humidity is 70%.

First, on a horizontally placed insulating plate, for example, an acrylic plate coated with Teflon (registered trademark), two plates of SUS304 (JIS) in which surfaces serving as electrodes were electrolytically polished and in which the plate thickness was 2 mm were arranged such that a distance between the electrodes was 2 mm. Here, in the two electrode plates, the direction of the normal thereto was set to a horizontal direction. Powder to be measured of 200±1 mg was charged into an air gap between the two electrode plates, thereafter a magnet whose cross-sectional area was 2.4 $cm^2$ was arranged behind each of the electrode plates and thus a bridge of the powder to be measured was formed between the electrodes. In this state, a direct-current voltage of 500 V was applied between the electrodes, a current value flowing through the powder to be measured was measured by a two-terminal method and thus an electrical resistivity (specific resistance) was calculated. Here, a super insulation meter "SM-8215" made by HIOKI E.E. CORPORATION was used. A formula for the calculation of the electrical resistivity (specific resistance) was that electrical resistivity (specific resistance) (Ω·cm)=measured resistance value (Ω)×cross-sectional area (2.4 $cm^2$)/distance between electrodes (0.2 cm). The resistivity (specific resistance) (Ω·cm) when the voltage of 500 V was applied was measured. Although various magnets can be used as the magnet to be used as long as the powder can form a bridge, in this embodiment, a permanent magnet in which a flux density on the surface was 1000 or more gauss, for example, a ferrite magnet was used.

An electrical resistance value in a low temperature and low humidity environment, specifically, in an environment in which the temperature was 10° C. and the relative humidity was 35% and an electrical resistance value in a high temperature and high humidity environment, specifically, in an environment in which the temperature was 30° C. and the relative humidity was 70% are shown. Here, the electrical resistance values described in the table are indicated as logarithmic values. In other words, the electrical reference value R (specific resistance) of $1\times10^6$ Ω·cm is calculated as Log R, and thus a converted value is shown as 6.0. An environment difference in the electrical resistance refers to a value obtained by subtracting the electrical resistance value in the high temperature and high humidity environment from the electrical resistance value in the low temperature and low humidity environment.

(Magnetic Property)

A room-temperature dedicated vibration sample type magnetometer (VSM) ("VSM-P7" made by Toei Industry Co., Ltd.) was used to apply an external magnetic field in a range of 0 to 50000 A/m (oersteds) continuously in one cycle, and thus a magnetization $\sigma_{1k}$ was measured.

(Measurement of Particle Diameter)

The average particle diameter of the carrier core material was measured with a "Microtrac Model 9320-X100" made by Nikkiso Co., Ltd. The particle diameter (μm) is based on volume unless otherwise stated. The particle diameter of the precalcined powder in the slurry was also measured with the "Microtrac Model 9320-X100" made by Nikkiso Co., Ltd. The particle diameter $D_{90}$ is a particle diameter at the time of 90% cumulation in a particle diameter cumulative distribution.

TABLE 1

| | Precalcination temperature ° C. | Slurry $D_{90}$ μm | Full calcination temperature ° C. | Oxygen concentration Before switching ppm | Oxygen concentration After switching ppm | Oxygen concentration Switching time h | Composition Fe Mass % | Composition Mn Mass % | Composition Mg Mass % | Composition Ca Mass % |
|---|---|---|---|---|---|---|---|---|---|---|
| Example 1 | 800 | 2.4 | 1100 | 5000 | 6500 | 1 | 49.1 | 20.5 | 1.6 | 0.2 |
| Example 2 | 800 | 2.4 | 1100 | 5000 | 6500 | 3 | 49.1 | 20.5 | 1.6 | 0.2 |
| Example 3 | 800 | 2.4 | 1100 | 5000 | 9000 | 1 | 49.1 | 20.5 | 1.6 | 0.2 |
| Example 4 | 800 | 2.4 | 1100 | 2000 | 4000 | 1 | 49.1 | 20.5 | 1.6 | 0.2 |
| Example 5 | 800 | 2.4 | 1100 | 8000 | 9000 | 1 | 49.1 | 20.5 | 1.6 | 0.2 |
| Example 6 | 800 | 1.5 | 1100 | 5000 | 6500 | 1 | 49.1 | 20.5 | 1.6 | 0.2 |
| Example 7 | 800 | 3.5 | 1100 | 5000 | 6500 | 1 | 49.1 | 20.5 | 1.6 | 0.2 |
| Example 8 | 800 | 2.4 | 1100 | 5000 | 6500 | 1 | 49.1 | 20.5 | 1.6 | 0.05 |
| Example 9 | 800 | 2.4 | 1100 | 5000 | 6500 | 1 | 49.1 | 20.5 | 1.6 | 0.5 |
| Example 10 | 800 | 2.4 | 1100 | 5000 | 6500 | 1 | 51.0 | 17.0 | 3.1 | 0.2 |
| Comparative example 1 | 800 | 2.4 | 1100 | 5000 | 5000 | 0 | 49.1 | 20.5 | 1.6 | 0.2 |
| Comparative example 2 | 800 | 2.4 | 1100 | 5000 | 6500 | 5 | 49.1 | 20.5 | 1.6 | 0.2 |
| Comparative example 3 | 800 | 2.4 | 1100 | 5000 | 12000 | 1 | 49.1 | 20.5 | 1.6 | 0.2 |
| Comparative example 4 | 800 | 2.4 | 1100 | 1000 | 1000 | 0 | 49.1 | 20.5 | 1.6 | 0.2 |
| Comparative example 5 | — | 0.9 | 1100 | 5000 | 6500 | 1 | 49.1 | 20.5 | 1.6 | 0.2 |
| Comparative example 6 | 1000 | 4.0 | 1100 | 5000 | 6500 | 1 | 49.1 | 20.5 | 1.6 | 0.2 |
| Comparative example 7 | 800 | 2.4 | 1100 | 5000 | 6500 | 1 | 49.1 | 20.5 | 1.6 | 0 |
| Comparative example 8 | 800 | 2.4 | 1100 | 5000 | 6500 | 1 | 49.1 | 20.5 | 1.6 | 0.6 |

| | Magnetization $\sigma_{1k}$ $Am^2/kg$ | Electrical Resistance N/N environment Log $R_N$ | Electrical Resistance L/L environment Log $R_L$ | Electrical Resistance H/H environment Log $R_H$ | Environment Resistance Log $R_L$ − Log $R_H$ |
|---|---|---|---|---|---|
| Example 1 | 60 | 8.4 | 8.4 | 8.3 | 0.1 |
| Example 2 | 60 | 8.4 | 8.4 | 8.1 | 0.3 |
| Example 3 | 57 | 8.7 | 8.7 | 8.6 | 0.1 |
| Example 4 | 63 | 8.1 | 8.1 | 7.8 | 0.3 |
| Example 5 | 57 | 8.7 | 8.8 | 8.5 | 0.3 |
| Example 6 | 61 | 8.4 | 8.5 | 8.3 | 0.2 |
| Example 7 | 59 | 8.5 | 8.5 | 8.3 | 0.2 |
| Example 8 | 63 | 8.2 | 8.2 | 8.1 | 0.1 |
| Example 9 | 57 | 8.6 | 8.7 | 8.5 | 0.2 |
| Example 10 | 55 | 8.8 | 8.8 | 8.5 | 0.3 |
| Comparative example 1 | 61 | 8.4 | 8.5 | 7.9 | 0.6 |
| Comparative example 2 | 60 | 8.4 | 8.5 | 8.0 | 0.5 |
| Comparative example 3 | 53 | 8.8 | 8.9 | 8.5 | 0.4 |
| Comparative example 4 | 62 | 8.2 | 8.2 | 7.8 | 0.4 |
| Comparative example 5 | 61 | 8.3 | 8.4 | 8.0 | 0.4 |
| Comparative example 6 | 58 | 8.4 | 8.4 | 7.9 | 0.5 |
| Comparative example 7 | 63 | 8.1 | 8.2 | 7.8 | 0.4 |
| Comparative example 8 | 56 | 8.7 | 8.7 | 8.3 | 0.4 |

In the carrier core materials of examples 1 to 10, the compositions specified in the present invention were provided, the particle diameter $D_{90}$ of the precalcined powder in the slurry in the manufacturing process was set equal to or less than 3.5 μm, the switching of the oxygen concentration in the calcined atmosphere in the full calcination step was started at least 1 hour before the completion of the heating stage, the switching time was set to fall within a range of 1 to 3 hours, the switching of the oxygen concentration was completed before the calcination temperature in the cooling stage became less than 800° C., the magnetization $\sigma_{1k}$ fell within a range of 55 to 63 $Am^2/kg$, in the electrical resistance (in the N/N environment), log $R_N$ was equal to or more than 8.1 and the environment difference (log $R_L$− log $R_H$) was so small as to be equal to or less than 0.3.

By contrast, in the carrier core material of comparative example 1, the oxygen concentration in the calcination step was set to 5000 ppm without being switched, and thus the environment difference (log $R_L$−log $R_H$) in the electrical resistance was so large as to be 0.6.

On the other hand, in the carrier core material of comparative example 2, the switching of the oxygen concentration was started after the elapse of 2 hours since the entrance of the heating stage, and at the time of 800° C. in the cooling stage, the oxygen concentration was not able to be switched to 6500 ppm. Consequently, a sufficient oxygen concentration gradient was not able to be provided, and thus the environment difference (log $R_L$−log $R_H$) in the electrical resistance was so large as to be 0.5.

In the carrier core material of comparative example 3, the oxygen concentration after the switching in the calcination step was so high as to be 12000 ppm, and thus the oxidation reaction of the carrier core material was excessive, with the result that the environment difference (log $R_L$−log $R_H$) in the electrical resistance was so large as to be 0.4 and that the magnetization $\sigma_{1k}$ was so low as to be 53 $Am^2/kg$.

In the carrier core material of comparative example 4, the oxygen concentration in the calcination step was set to 1000 ppm without being switched, and thus the environment difference (log $R_L$−log $R_H$) in the electrical resistance was so large as to be 0.4.

In the carrier core material of comparative example 5, precalcination was not performed, and thus the particle diameter $D_{90}$ in the slurry was small, and part of MgO reacts with water, with the result that the viscosity of the slurry was recognized to be increased. Since the raw materials were excessively fine, crystal growth in the calcination step was rapid such that abnormal crystal growth occurs, with the result that the environment difference (log $R_L$−log $R_H$) in the electrical resistance was so large as to be 0.4.

In the carrier core material of comparative example 6, although the individual component raw materials were precalcined, the particle diameter $D_{90}$ of the precalcined powder in the slurry was so large as to be 4.0 μm, and thus coarse particles serve as the starting point such that abnormal crystal growth occurs in the calcination step, with the result that the environment difference (log $R_L$−log $R_H$) in the electrical resistance was so large as to be 0.5.

The carrier core material of comparative example 7 did not contain a Ca component, and thus the environment difference (log $R_L$−log $R_H$) in the electrical resistance was so large as to be 0.4 whereas the carrier core material of comparative example 8 contains an excessive amount of Ca component which was 0.6 mass %, and thus the environment difference (log $R_L$−log $R_H$) in the electrical resistance was so large as to be 0.4.

The invention claimed is:

1. A carrier core material, comprising:

ferrite particles comprising:

48 to 52 mass % of Fe;

16 to 22 mass % of Mn;

1.0 to 3.5 mass % of Mg; and 0.05 to 0.5 mass % of Ca, wherein when an electrical resistance value with an applied voltage of 500 V in an environment (in an L/L environment) in which a temperature is 10° C. and a relative humidity is 35% is $R_L$ (Ω·cm), and an electrical resistance value with an applied voltage of 500 V in an environment (in an H/H environment) in which a temperature is 30° C. and a relative humidity is 70% is $R_H$ (Ω·cm), formula (1) below is satisfied:

$$0.1 \leq (\log R_L - \log R_H) \leq 0.3 \quad (1).$$

2. An electrophotographic development carrier, wherein a surface of the carrier core material according to claim 1 is coated with a resin.

3. An electrophotographic developer comprising:

the electrophotographic development carrier according to claim 2; and a toner.

* * * * *